US005215282A

United States Patent [19]

Bonutti

[11] Patent Number: 5,215,282

[45] Date of Patent: Jun. 1, 1993

[54] ADJUSTABLE ARMREST ASSEMBLY

[76] Inventor: Peter M. Bonutti, 1303 W. Evergreen Plaza, Effingham, Ill. 62401

[21] Appl. No.: 597,691

[22] Filed: Oct. 15, 1990

[51] Int. Cl.[5] ..... B68G 5/00

[52] U.S. Cl. ..... 248/118; 248/118.3; 248/276

[58] Field of Search ..... 248/118, 118.1, 118.3, 248/118.5, 276, 279, 285, 287; 297/411, DIG. 3

[56] References Cited

U.S. PATENT DOCUMENTS

| | | | |
|---|---|---|---|
| 2,602,488 | 7/1952 | Conning | 248/118 |
| 4,277,102 | 7/1981 | Aaras | 248/118 |
| 4,913,393 | 4/1990 | Wood | 248/118 |
| 4,960,304 | 10/1990 | Frantz | 297/DIG. 3 X |

FOREIGN PATENT DOCUMENTS

| | | | |
|---|---|---|---|
| 62687 | 8/1944 | Denmark | 248/118 |
| 42022 | 10/1965 | German Democratic Rep. | 248/118 |
| 8900111 | 1/1989 | PCT Int'l Appl. | 248/118 |

*Primary Examiner*—Blair M. Johnson
*Attorney, Agent, or Firm*—Tarolli, Sundheim & Covell

[57] ABSTRACT

An armrest assembly is for use with a piece of furniture and for supporting an arm of a person seated in a chair to relieve the weight of the arm on the shoulder, neck, elbow and wrist. The armrest assembly includes an armrest, means for selectively positioning the armrest vertically and/or longitudinally and/or laterally and/or pivotally in one of a plurality of positions relative to the piece of furniture, and means for fixing the armrest in a selected one of the plurality of positions. The armrest supports both the elbow and a portion of the forearm in an anatomically correct manner. The armrest is contoured and padded to contact the limb properly to minimize injury arising through long term contact. The armrest may be movable to ease ingress and egress from the chair. The armrest may be built as part of a specifically designed chair; it may be an attachment for an existing chair; or it may be an attachment for an existing table. The armrest is properly contoured to avoid any injury to the supported arms which might be caused by the long duration contact of the arms with the supports. With the arms thus properly supported, fatigue is minimized because the neck and shoulder muscles do not need to support the full weight of the arms.

14 Claims, 5 Drawing Sheets

Fig. 3
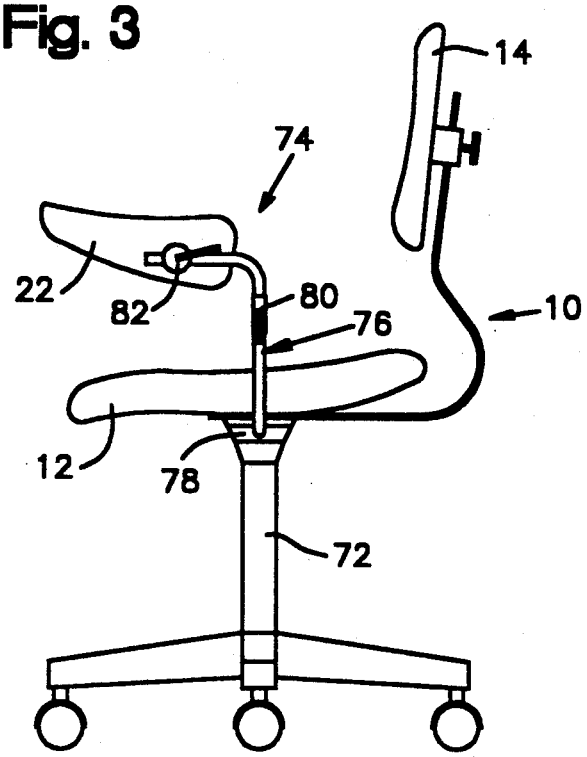
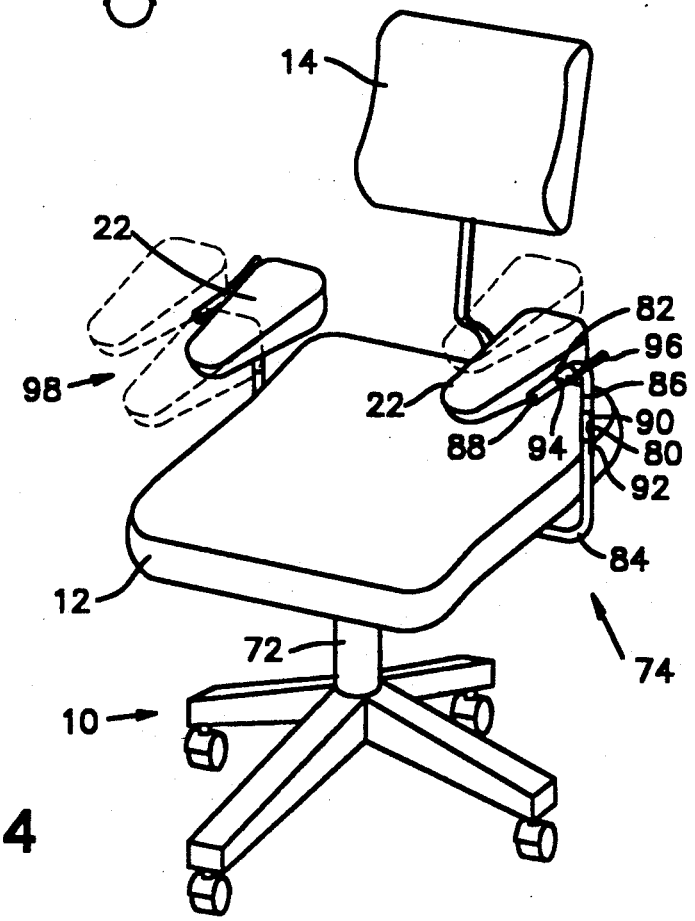
Fig. 4

ADJUSTABLE ARMREST ASSEMBLY

BACKGROUND OF THE INVENTION

A Newsweek magazine article of Aug. 20, 1990 on repetitive strain injury notes that many computer operators are claiming that the design of their computers has led to physical injuries. Specifically, the article notes that "hours at the computers put continuous stress on the wrists, elbows and shoulders. Tendons in the arm become inflamed, squeezing the nerves; the result is numbness and pain. Without early diagnosis and treatment, these injuries can develop into serious lifelong disabilities and loss of ability to work."

Existing furniture for typists and computer users does not properly position the computer operator's body relative to the keyboard, and does not properly support the body in any given position. One function of the elbow is to position the hand in space. Thus, proper positioning of the elbow itself is essential to proper positioning of the hand. The elbow is typically supported by the armrest on a chair. However, the armrests on a typical office chair are completely useless to support the arms of someone working at a computer keyboard. The armrests are too far back and too low because the chair must be designed to fit under a table or desk, and because the occupant must be able to get into and out of the chair easily without serious interference from the armrests. The armrests do not properly support the weight of the arms. Thus, the trapezius muscle and other muscles of the neck and shoulder must support the full weight of the arms for prolonged periods of time, leading to chronic shoulder and neck pain, upper back problems, etc.

An armrest which is not properly padded will cause ulnar nerve problems. An armrest needs to provide broad support over a large contact area of the arm. It should also be adjustable to fit different users rather than be fixed in one location.

SUMMARY OF THE INVENTION

In accordance with the present invention, furniture is designed around (fitted to) the human body in order to support the arms in a functional anatomically correct position. The position of the arms when typing at a keyboard is noted, and structure is provided which properly supports the arms in that position. With the arms thus properly supported, fatigue is minimized because the neck and shoulder muscles do not need to support the full weight of the arms. The supports are completely adjustable in up to three planes of movement to properly position the arms relative to the keyboard. The supports may be contoured to avoid any injury to the supported arms which might be caused by the long duration contact of the arms with the supports. Thus, the supports are anatomically, functionally, and orthopedically correct.

The present invention is therefore an armrest assembly for use with a piece of furniture and for supporting an arm of a person seated in a chair. The armrest assembly includes an armrest, means for selectively positioning the armrest vertically and/or longitudinally and/or laterally and/or pivotally in one of a plurality of positions relative to the piece of furniture, and means for fixing the armrest in a selected one of the plurality of positions. The armrest supports both the elbow and a portion of the forearm in an anatomically correct manner. The armrest is contoured and padded to contact the limb properly to minimize injury arising through long term contact. The armrest may be movable to ease ingress and egress from the chair. The armrest may be built as part of a specifically designed chair; it may be an attachment for an existing chair; or it may be an attachment for an existing table.

BRIEF DESCRIPTION OF THE DRAWINGS

Further features of the present invention will become apparent to those skilled in the art to which the present invention relates from reading the following specification with reference to the accompanying drawings, in which:

FIG. 3 is a pictorial illustration of an armrest assembly and armrest attached to a chair;

FIG. 4 is an enlarged perspective view of the armrest assembly of FIG. 3;

DESCRIPTION OF PREFERRED EMBODIMENTS

Figure 1:
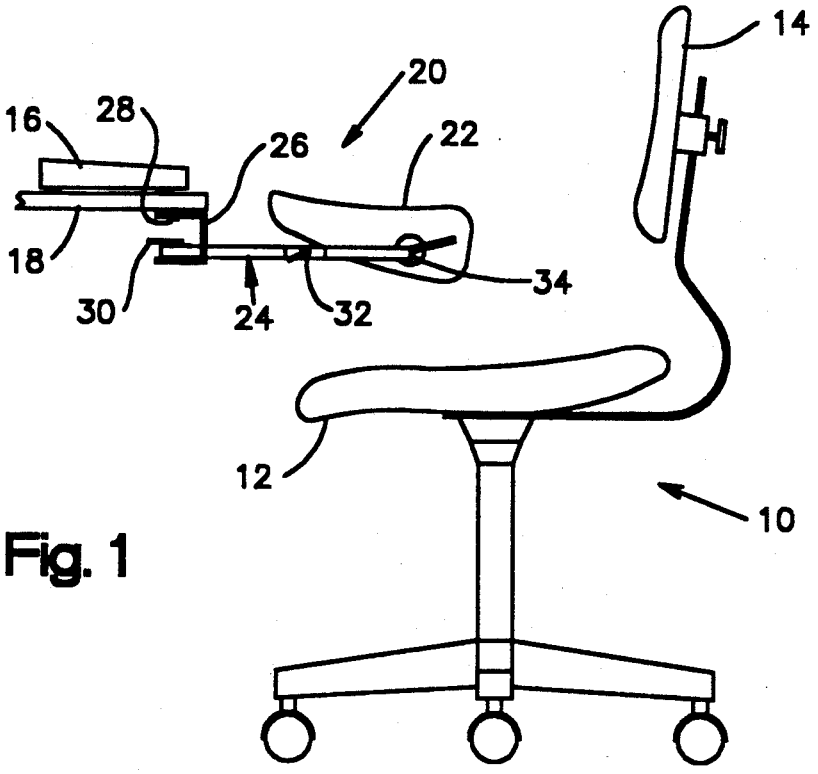
FIG. 1 is a pictorial illustration of an armrest assembly and armrest in accordance with the present invention, shown attached to a desk.

FIG. 1 illustrates the use of an armrest assembly in accordance with the present invention attached to a desk. A chair 10 has a chair bottom cushion 12 and a chair back cushion 14 for supporting an operator (not shown) working at a computer keyboard 16. The keyboard 16 rests on the upper surface of a desk 18. An armrest assembly 20 is attached to the desk 18. The armrest assembly 20 includes an armrest 22 connected by an armrest support 24 to a frame 26. The frame 26 is fixed by suitable fasteners 28 to the underside of the desk 18. A plurality of locking adjusters 30, 32, and 34 allow the operator to selectively position the armrest 22 relative to the desk 18.

Figure 2:
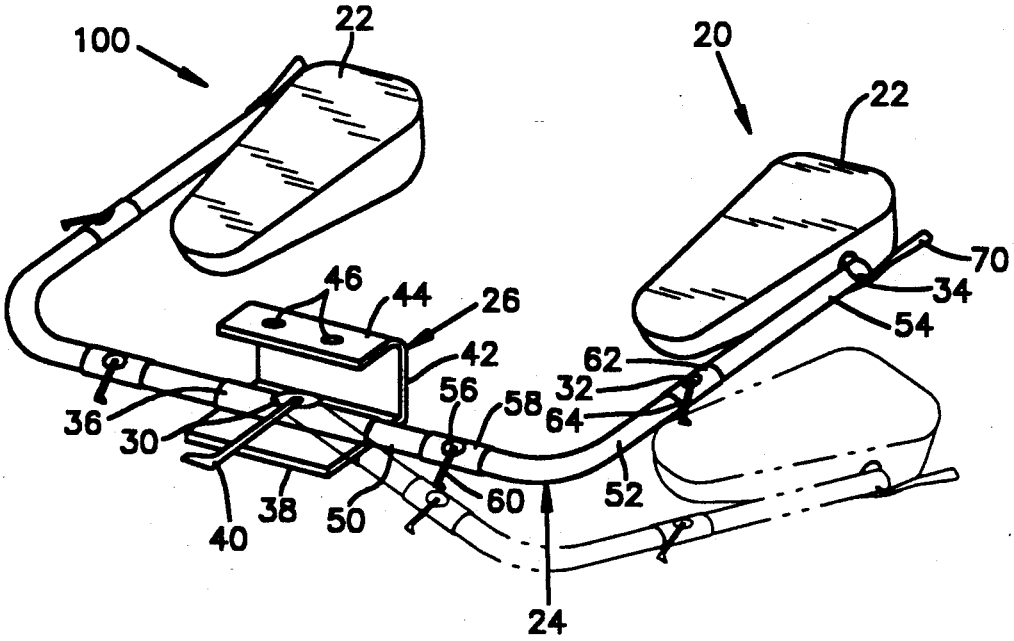
FIG. 2 is an enlarged perspective view of the armrest assembly of FIG. 1.

FIG. 2 illustrates the armrest assembly 20 in more detail. The armrest support 24 is received in a locking sleeve 36 which is connected by the locking adjuster 30 to a lower frame portion 38 of the frame 26. The locking adjuster 30 has a handle 40. The frame 26 includes a rear frame portion 42 and an upper frame portion 44. A plurality of fastener openings 46 are formed in the upper frame portion 44 for receiving the fasteners 28 (FIG. 1). The armrest support 24 includes an inner support tube 50, a forward support tube 52, and a rearward support tube 54. The armrest assembly 20 shown in FIG. 1 preferably also has connected to it a second armrest assembly 100 as shown in FIG. 2, with a second armrest 22 for the right arm of the operator. The armrest assembly 100 can be a mirror image of the armrest assembly 20.

A lateral adjuster 56 connects the inner support tube 50 and the forward support tube 52. The lateral adjuster 56 can be of any suitable known construction for positioning two tube sections axially relative to each other then securing them in a selected one of a plurality of positions. The specific lateral adjuster 56 illustrated includes a sleeve 58, which receives the ends of the inner support tube 50 and the forward support tube 52, and a handle 60. By suitable adjustment of the lateral adjuster 56, the operator can move the forward support tube 52 relative to the inner support tube 50 to one of a plurality of different positions, and lock them in any selected one position. This positions the armrest 22 laterally relative to the frame 26 and thus the desk 18. By providing a sufficient range of motion, the armrest 22 can be positioned at an anatomically correct position laterally relative to the desk 18 and thus the keyboard 16.

The longitudinal adjuster 32 connects the forward support tube 52 and the rearward support tube 54. The longitudinal adjuster, like the lateral adjuster, can be of any suitable known construction for positioning two tube sections axially relative to each other then securing them in a selected one of a plurality of positions. The longitudinal adjuster 32 includes a sleeve 62 which receives the ends of the forward support tube 52 and the rearward support tube 54, and a handle 64. By suitable adjustment of the longitudinal adjuster 32, the operator can move the forward support tube 52 relative to the rearward support tube 54 to a plurality of different positions, and lock them in any selected one position. This positions the armrest 22 longitudinally relative to the frame 26 and thus the desk 18. By providing a sufficient range of motion, the armrest 22 can thus be positioned at an anatomically correct position longitudinally relative to the desk 18 and thus the keyboard 16.

The locking adjuster 30 provides for vertical movement of the armrest 22 relative to the desk 18. The inner support tube 50 is received in the sleeve 36 of the locking adjuster 30 in a manner such that when the handle 40 is operated, the inner support tube 50 can be rotated within the sleeve 36 to a plurality of different settings to position the armrest 22 vertically relative to the frame 26 and thus the desk 18. The armrest 22 is then locked in a selected vertical position by operation of the handle 40.

The locking adjuster 30 also provides for swinging movement of the armrest 22 relative to the desk 18. The sleeve 36 of the locking adjuster 30 is pivotable relative to the lower frame portion 38. When the handle 40 is appropriately operated the sleeve 36 and the inner support tube 50 can be pivoted relative to the frame 26 to a plurality of different positions, one of which is shown in phantom in FIG. 2. This swinging movement allows the operator to temporarily move the armrest assembly 20 out of a working position, to make it easier for the operator to enter and exit the chair 10. The armrest assembly 20 is locked in a selected swinging position by operation of the handle 40 which may include a suitable detent mechanism for such purposes. Alternatively, the armrest assembly can be swung vertically upwards and thus out of the way. There are other known structures which can be used to perform these functions.

Once the armrest support 24 is fixed in position relative to the desk 18, the pivotal adjuster 34 provides for pivoting movement of the armrest 22 relative to the armrest support 24. The pivotal adjuster 34 includes a handle 70 and may include a universal joint, or a ball and socket joint, or other type of construction, which allows for movement of the armrest 22 in three degrees of freedom. The armrest 22 can therefore be "rolled" about an axis extending parallel to the rearward support tube 54; it can be "pitched" about an axis extending parallel to the inner support tube 50; and it can be "yawed" about an axis extending vertically downward through the adjuster 34.

Figure 9:
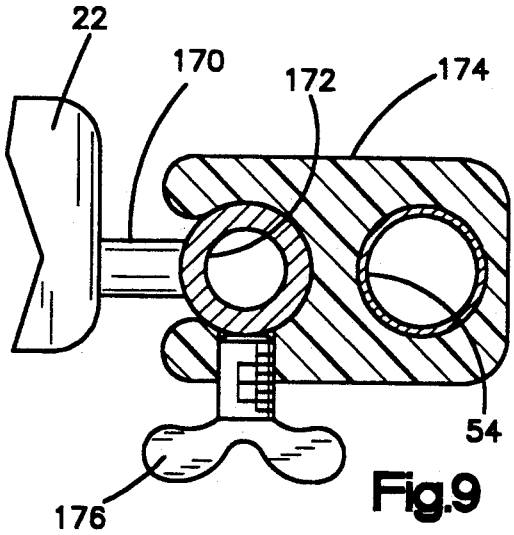
FIG. 9 is a view partially in section of a pivotal adjuster for use in apparatus embodying the present invention.

The specific construction of the pivotal adjuster 34 is not critical to the invention, so long as it allows for adjustment of the armrest 22 in the desired range of movement. One specific construction which allows such range of movement is illustrated in FIG. 9. The tube section 54 is fixed in a housing 174 having a socket in which is received a ball 172. An arm 170 extends from the ball 172 into the armrest 22. A set screw 176 operable by a handle secures the ball 172 in position as desired. By virtue of the ball and socket construction, the armrest 22 can be pivotally adjusted in all three degrees of freedom. Again, there are many known types of adjusters (joints) which can function in this location.

Thus, the armrest 22 can be selectively pivotally positioned in any one of a plurality of different pivotal positions, then fixed in that position by locking movement of the handle 70. For example, the armrest 22 may be positioned to roll slightly inwards, because as the arm moves medially, it rotates (rolls) slightly. This can help to relieve pressure on the inside of the elbow, to accommodate that rolling movement and to avoid damage to the ulnar nerve area. The armrest 22 can be angled (pitched) up or down, to accommodate operators of different height. Preferably it is angled slightly upwards as indicated in FIGS. 1 and 3, for example. The armrest 22 may be angled inwardly, because the operator's hands when on a keyboard are often located laterally inward of the elbows. Again, with the present invention, the armrest is adjustable in all of these degrees of movement.

It should be noted that the armrest support 24 need not be made of tubes as described herein, but can be of any suitable construction such as slotted arms, plastic rods, etc. Also, suitable structures for adjusting and locking such apparatus is well known and readily available; any apparatus which provides for the desired ability to elevate the armrest, slide it forward and backward, etc., is usable. For example, an adjuster may be of the type which, when the weight of the operator's arm is not placed on the armrest, is relatively free to rotate, but which locks when swivelled into position and weight is applied. Further, other types of attachment to the desk 18 or to the chair 10 are possible, including clamps, Velcro® straps, or suction cups. Such variations are within the ordinary skill of the art and are thus within the scope of the invention.

FIG. 3 illustrates the use of an armrest assembly in accordance with the present invention attached to the chair 10 rather than the desk 18. The armrest assembly could be built into the chair 10 when the chair 10 is manufactured, or it could easily be constructed as an add-on feature for attachment to existing chairs.

In the chair 10 the chair bottom cushion 12 and the chair back cushion 14 are connected by a chair frame 72. An armrest assembly 74 includes an armrest 22 connected by an armrest support 76 to the chair frame 72. The armrest support 76 is fixed at 78 by suitable fastening structure to the chair frame 72. Locking adjusters 80 and 82 are operable to allow the operator to selectively position the armrest 22 relative to the chair bottom cushion 12.

The locking height adjuster 80 (FIG. 4) connects the lower support tube 84 and the upper support tube 86. The height adjuster 80 includes a sleeve 90 which receives the ends of the lower support tube 84 and the upper support tube 86. The height adjuster 80 has a handle 92. The height adjuster 80 can be of any construction for positioning two tube sections axially relative to each other then securing them in a selected one of a plurality of positions. By suitable adjustment of the height adjuster 80, the operator can move the upper support tube 86 relative to the lower support tube 84 to any one of a plurality of different positions, then lock them into place. This positions the armrest 22 vertically relative to the chair bottom cushion 12. By providing a sufficient range of motion, the armrest 22 can thus be positioned at an anatomically correct position vertically relative to the chair bottom cushion 12.

The locking adjuster 82 connects the upper support tube 86 and the forward support tube 88. The adjuster 82 includes a sleeve 94 which receives the ends of the forward support tube 88 and the upper support tube 86. The adjuster 82 has a handle 96. The height adjuster 82 can be of any suitable known construction for positioning two tube sections axially relative to each other then securing them in a selected one of a plurality of positions. (In the case of any locking mechanism as used in the present invention, the locking mechanism is preferably place near the operator's hand for ease of actuation and adjustment.) By suitable adjustment of the adjuster 82, the operator can move the forward support tube 88 relative to the upper support tube 86 to any one of a plurality of different positions, then lock them into place. This positions the armrest 22 longitudinally (forward and rearward) relative to the chair bottom cushion 12. By providing a sufficient range of motion, the armrest 22 can thus be positioned at an anatomically correct position longitudinally relative to the chair bottom cushion 12.

The armrest 74 may also include similar adjusters (not shown) for lateral positioning of the armrest 22 relative to the chair bottom cushion 12, and/or for swinging the armrest 22 relative to the chair bottom cushion 12, as described above. The chair 10 shown in FIG. 4 preferably also includes a second armrest assembly 98 with a second armrest 22 for supporting the right arm of the operator. The armrest assembly 98 can be a mirror image of the armrest assembly 74. FIG. 4 also shows, in phantom, various positions of the armrests as illustrative of the ability to position the armrest in multiple planes of movement.

Figure 5:
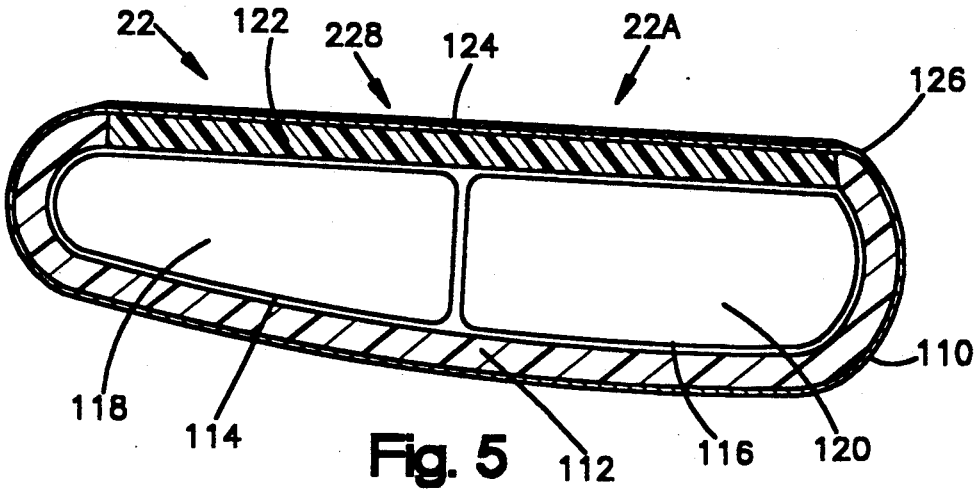
FIG. 5 is a sectional view of the armrest.

The armrest 22 may be of many configurations. One specific configuration is shown in FIG. 5. As indicated in FIG. 5, the armrest 22 may include a hard plastic shell 110 within which is secured a foam liner 112. The entire armrest 22 may be filled with the foam liner 112, to provide a resilient construction. Alternatively, the armrest 22 may include, as shown in FIG. 5, a pair of adjustably inflatable bladders 114 and 116 within which are formed air pockets 118 and 120 respectively. A foam cushion layer 122 is disposed on top of the bladders 114 and 116. The top surface 124 and the remaining side portions 126 are covered with a material which can be any breathable low-friction material. The material should be smooth enough to allow the operator's arm to slide fairly easily and which still breathes for comfort. A smooth vinyl or leather material would be suitable. The armrest 22 has a rearward portion 22A for supporting the operator's elbow on an arm contact surface 128, and a forward portion 22B for supporting at least a portion of the operator's forearm on the arm contact surface 128.

The size of the air pockets 118 and 120 may be adjusted in a known manner (as by a hand pump) in order to contour the armrest 22 to the shape desired by the particular operator. The armrest 22 should slightly cup the elbow. The armrest 22 is preferably contoured in the direction of roll slightly inwards, compensating for the fact that an operator's elbow experiences more pressure on the inside of the elbow, the medial side, and accommodating that. There may be provided further bladders also, to vary height, firmness, contouring, etc. Alternatively, additional pieces of foam like the foam layer 122 may be added to adjust the size and contour of the armrest 22 to the shape desired by the particular operator. These may be attached by any mechanism such as glue or Velcro® fasteners. The armrests 22 can also be custom fitted for an individual with polyurethane fill which hardens permanently.

Accordingly, it can be seen that the armrest 22 is completely adjustable, in itself, to fit the operator's need for an anatomically correct design. It can be seen that the armrest 22 may be quite broad and long, to provide a large contact area for the arm. This contact area is long enough to place support under the operator's forearm as well as the elbow, thus avoiding point contact which can lead to possible ulnar nerve damage and cubital tunnel syndrome.

Figure 6:
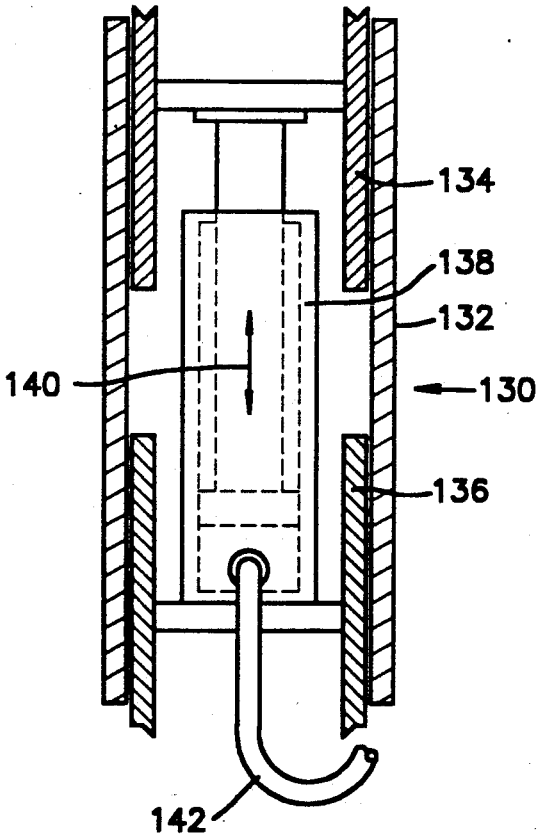
FIG. 6 is an illustration of one type of adjuster usable in the armrest assembly of the present invention.

It should also be noted that other forms of locking adjusters can be used in addition to the locking adjusters described above. For example, FIG. 6 illustrates a pneumatically operated locking adjuster 130 having a sleeve 132 in which are received two tube end portions 134 and 136. The tube end portions 134 and 136 in FIG. 6 represent the end portions of any of the tube pairs shown in the other Figures which are relatively adjustable. The adjuster 130 includes a pneumatic ram assembly 138 operable in the directions indicated by the arrow 140. Fluid under pressure is supplied to the pneumatic ram assembly 138 through a fluid supply line 142. Actuation of the ram assembly 138 moves the tube portion 134 relative to the tube portion 136 in the desired direction by the desired amount. The sleeve 132 maintains the proper orientation and connection of the tube portions 134 and 136. The adjuster 130 is but one example of the many different types of adjusters which are usable in the armrest assemblies of the present invention.

The embodiment described above is relatively complex compared to what would be the simplest embodiment of the invention. In the simplest case, the armrest assembly includes a simple plastic (or other material) extension piece that is added on to an existing armrest to move the point of support for the arm forward. This could be a simple piece that is clipped or clamped or otherwise attached to the existing armrest. If desired, this simplest case could be enhanced by providing for vertical adjustability also, through merely adding layers of foam padding, or in a more complex manner by an adjustable air bladder or through adjustable tubing, etc. as described above. Similarly, to position the armrest relative to a work surface, the armrest may simply slide out from under a desk or table like a desk drawer. In this case, it can include a pair of individual armrests for the two arms, or it can be one wide piece for supporting both arms. These simpler embodiments are described to some extent in the following portion of the specification. It should be understood that the present invention includes all of these embodiments, from simple to complex.

Figure 8:
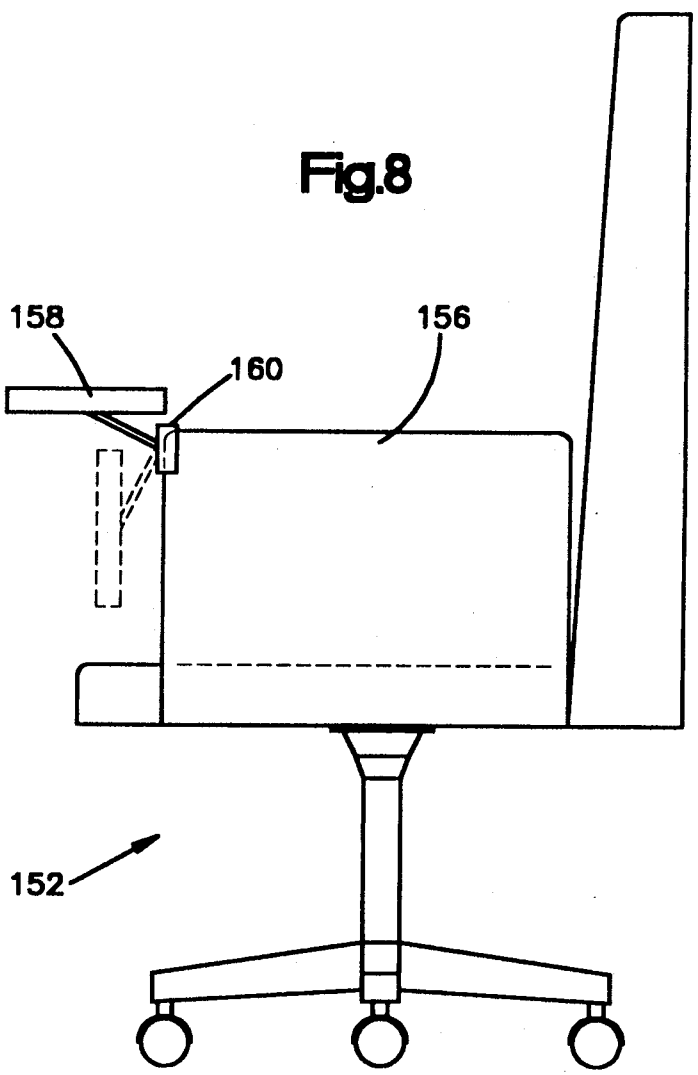
FIG. 8 is an illustration similar to FIG. 7 of a pivotally mounted armrest assembly attached to an existing armrest portion of a chair.
Figure 7:
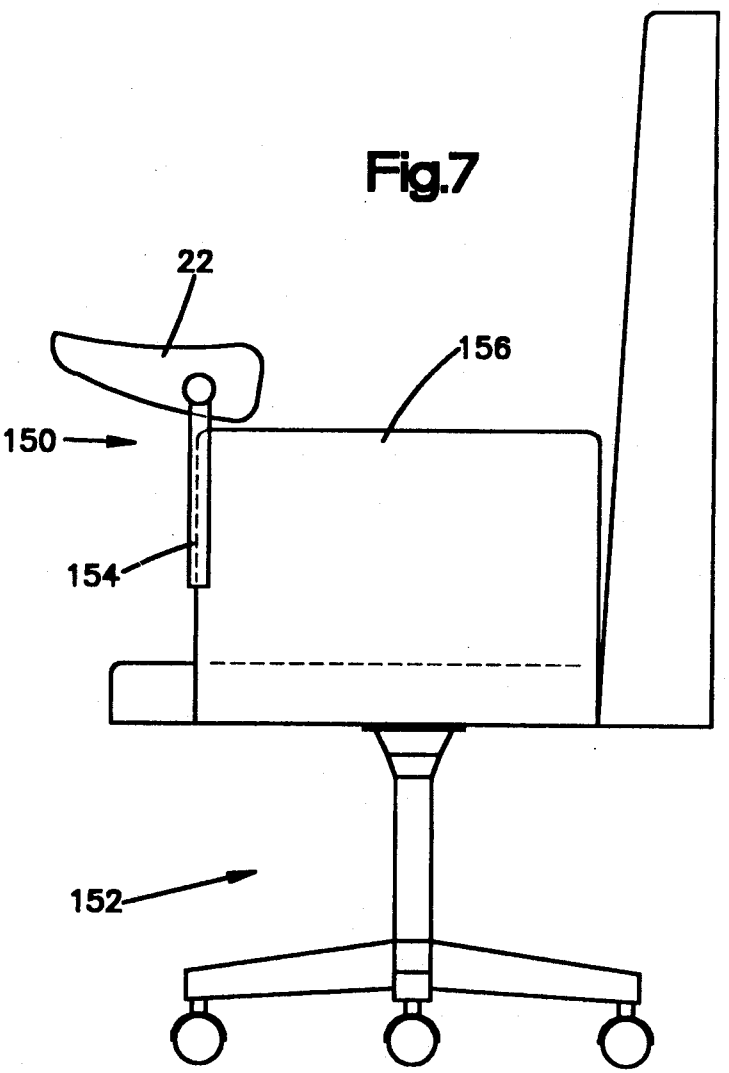
FIG. 7 is a pictorial illustration of an armrest assembly attached to an existing armrest portion of a chair.

FIG. 7 illustrates a simple clamp-on armrest assembly 150 which can be easily attached to an existing chair 152. The armrest assembly 150 includes an armrest 22 and a clamp 154. The clamp 154 is attached to the existing armrest portion 156 of the chair 152. The details of the structure of the clamp 154 are not described herein because they are not necessary to an understanding of the invention. The clamp 154 can be any suitable mechanism for attaching an armrest such as the armrest 22 to an existing chair. This could include tape, Velcro® fasteners, etc. It is not necessary to use a fully padded and contoured and adjustable armrest such as the armrest 22. Any simple device which will place the point of arm support forward and have a broad padded base will be suitable. The clamp assembly need not fix the armrest in place, but may simply allow the armrest to slide or pivot from a non-working position to a working position, as seen in FIG. 8 which, for example, illustrates an armrest 158 held by a clamp 160 to the existing armrest portion 156 of the chair 152. The armrest 158 is movable from a working position shown in solid lines to a non-working position shown in phantom.

FIG. 9 illustrates one simple type of pivotal adjuster. Attached to the armrest 22 by a pin 170 is a ball member 172. The ball member is received in a socket formed in a housing 174. The rearward support tube 54 is fixed in the housing 174. A set screw 176 is threaded into the housing 174 and engages the ball member 172. If the set screw 176 is threaded out of engagement with the ball member 172 the ball member 172 is free to rotate relative to the housing 174, and so the armrest 22 is also free to rotate in about all three axes and can be placed in any selected one of a plurality of different pivotal positions. When the set screw 176 is threaded back into engagement with the ball member 172, the ball member 172 is blocked from rotation relative to the housing 174, and the armrest 22 is fixed in the selected pivotal position.

Figure 11:
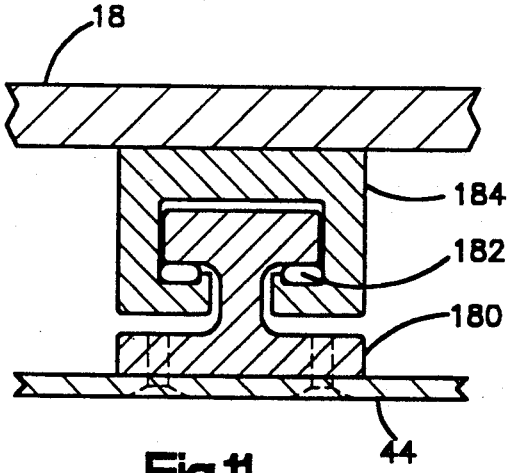
FIG. 11 is a view taken along line 11—11 of FIG. 10.
Figure 10:
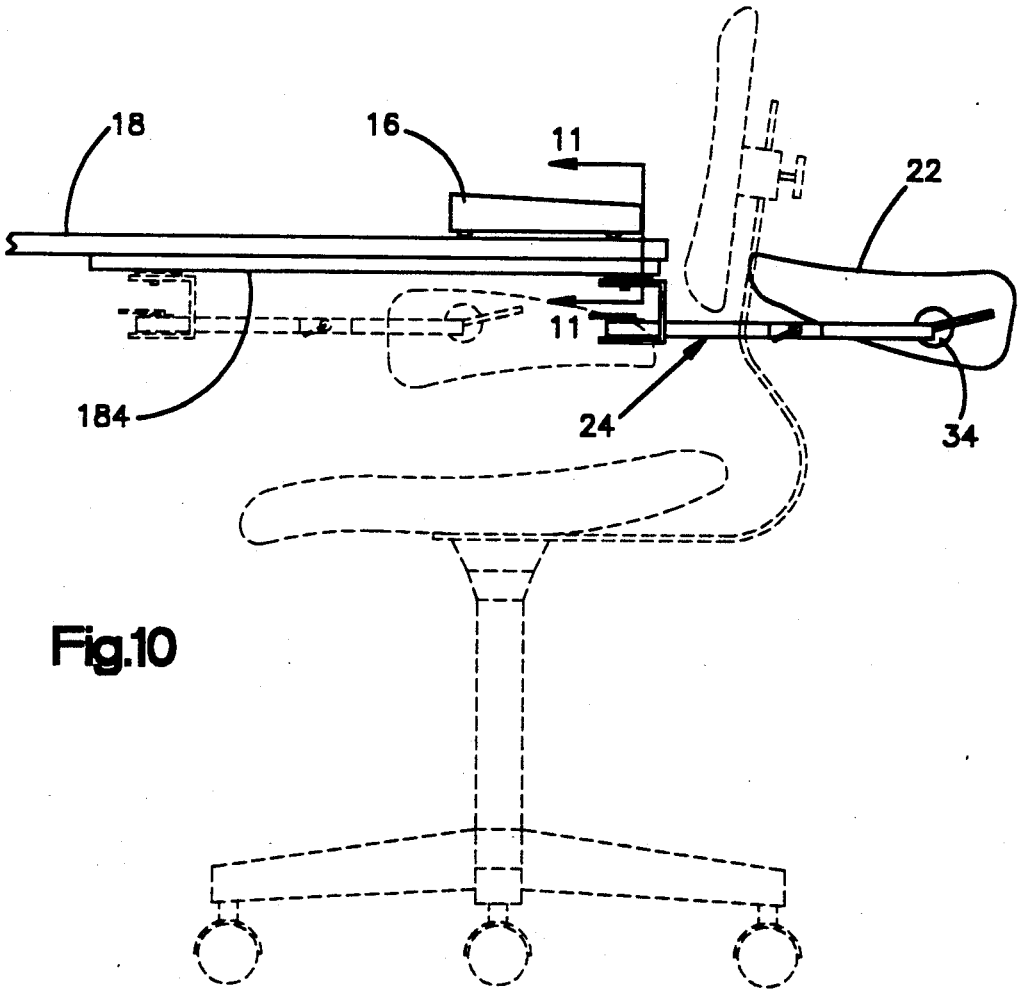
FIG. 10 is a view of an alternate apparatus for allowing movement of an armrest assembly into and out of a working condition.

FIGS. 10 and 11 illustrate an alternate construction for allowing movement of an armrest assembly into and out of a working position. The armrest assembly shown in FIGS. 9 and 10 slides from a non-working position (shown in phantom) under the desk 18 into a working position shown in solid. The upper frame portion 44 of the armrest assembly is fastened to a rail 180. The rail 180 rides on bearings 182 along a track 184 fastened to the underside of the desk 18. To move the armrest assembly from a working position to a non-working position, the armrest 22 is rotated by the pivotal adjuster 34 to a orientation in which it will fit under the desk 18. The armrest 22 and armrest support 24 are then slid underneath the desk 18 to the non-working position shown in phantom. In this position, the armrest assembly is out of the way of the operator.

Accordingly, it can be seen that the present invention provides an armrest assembly 20 for attachment to a piece of furniture 16 and for supporting an arm of a person seated in a chair 10. The armrest assembly 20 comprises an armrest 22, and an armrest support 24 for selectively positioning the armrest 22 in one of a plurality of positions relative to the piece of furniture 18. Specifically, the armrest assembly 20 includes an adjuster 30 for selectively vertically positioning the armrest 22 relative to the piece of furniture 18 in one of a plurality of upward and downward positions and for fixing the armrest 22 in the selected one of the plurality of upward and downward positions; an adjuster 32 for selectively longitudinally positioning the armrest 22 relative to the piece of furniture 18 in one of a plurality of forward and rearward positions and means for fixing the armrest 22 in the selected one of the plurality of forward and rearward positions; an adjuster 56 for selectively laterally positioning the armrest 22 relative to the piece of furniture 18 in one of a plurality of leftward and rightward positions and for fixing the armrest 22 in the selected one of the plurality of leftward and rightward positions; and an adjuster 34 for selectively pivotally positioning the armrest 22 relative to the piece of furniture 18 in one of a plurality of separate pivotal positions when the armrest 22 is fixed longitudinally and vertically and laterally in one position and for fixing the armrest 22 in the selected on of the plurality of pivotal positions.

Further, it can be seen that the present invention provides an armrest 22 which includes a rearward armrest portion 22A for supporting the elbow of the person's arm, and a forward armrest portion 22B for simultaneously supporting in the armrest 22 at least a portion of the forearm of the person's arm. The armrest assembly 22 includes pneumatically operated air bladders 114 and 116 for varying the shape (including the height) of the armrest 22. The armrest 22 has an arm contact surface 128 and may include padding such as padding 122 for selectively raising and lowering the height of the contact surface 128.

The armrest 22 may be selectively pivotally positioned relative to the piece of furniture 18 in one of a plurality of separate pivotal positions by rotating the armrest 22 in up to three directions of rotation around up to three axes of rotation by the pivotal adjuster 34 which can also block rotation of the armrest 22 in at least one of the three directions of rotation. The armrest assembly 20 may also include structure for swinging or sliding the armrest 22 out of a working position to allow easier access to a chair 10.

From the above description of the invention, those skilled in the art will perceive improvements, changes and modifications. Such improvements, changes and modifications within the skill of the art are intended to be covered by the appended claims.

I claim:

1. In an apparatus including (i) a desk having a front edge and a working surface, (ii) an armrest for supporting the arm of a person working at the desk, and (iii) separate support means connected between the armrest and the desk for supporting the armrest near the desk for movement between a plurality of positions relative to the desk;

the improvement wherein said support means supports the armrest for movement between a first position underneath the desk and a second position not underneath the desk for supporting the arm of a person working at the desk;

said support means including first and second relatively slidable members, said first relatively slidable member being connected with the armrest and being movable with the armrest when the armrest moves between its first position underneath the desk and its second position not underneath the desk, said second relatively slidable member being fixed to the desk, the armrest thereby sliding from its first position underneath the desk into its second position not underneath the desk upon relative sliding movement of said first and second relatively slidable members.

2. An apparatus as set forth in claim 1 wherein the first relatively slidable member is a rail attached to the armrest and the second relatively slidable member is a track attached to the desk, the rail riding along the track when the armrest is moved between its first position underneath the desk and its second position not underneath the desk.

3. An apparatus as set forth in claim 2 wherein the rail is attached to a support bracket connected with the armrest and the track is attached to an undersurface of the desk, the support bracket moving from a working position adjacent the front edge of the desk when the armrest is in its second position not underneath the desk and a storage position spaced back from the front edge of the desk when the armrest is in its first position underneath the desk.

4. An apparatus as set forth in claim 1 wherein said support means includes a support arm member connected between said armrest and said desk and a pivotal adjuster interconnecting said armrest and said support arm member, said pivotal adjuster supporting said armrest on said support arm member for movement about said pivotal adjuster relative to said support arm member between a working orientation for supporting the arm of a person working at the desk when said armrest is in its second position not underneath the desk, and a storage orientation different from said working orientation when said armrest is in its first position underneath the desk.

5. An apparatus as set forth in claim 1 wherein said support means includes a plurality of adjusters operable when said armrest is in its second position not underneath the desk, said adjusters being operable to allow selective locking positioning of said armrest at a plurality of distances from the front edge of the desk.

6. An apparatus as set forth in claim 5 wherein at least one of said adjusters is operable to allow selective locking positioning of said armrest at a plurality of locations spaced apart in a direction parallel to the front edge of the desk.

7. An apparatus as set forth in claim 5 wherein at least one of said adjusters is operable to allow selective locking positioning of said armrest at a plurality of locations above or below the working surface of the desk.

8. An apparatus as set forth in claim 1 wherein said support means includes a pivotal adjuster connected with said armrest and supporting said armrest for movement in three degrees of freedom among a plurality of different orientations for supporting the arm of a person working at the desk, all when the armrest is in its second position not underneath the desk.

9. An apparatus as set forth in claim 1 wherein said armrest has a relative hard shell and a relatively soft arm contact surface and an inflatable bladder within said shell for varying the contour of said arm contact surface without varying the contour of said shell.

10. An apparatus as set forth in claim 1 wherein said armrest has a relatively hard shell and a relatively soft arm contact surface, said apparatus further comprising a plurality of discrete individual pieces of padding selectively insertable into said armrest between said shell and said arm contact surface for varying the contour of said arm contact surface without varying the contour of said shell.

11. In an apparatus including (i) a desk having a front edge and a working surface thereon, (ii) an armrest for supporting the arm of a person working at the desk, and (iii) support means connected between the armrest and the desk for supporting the armrest near the desk for movement between a plurality of positions relative to the desk;

the improvement wherein the support means comprises a support arm connected between the armrest and the desk and movable (i) in a first direction parallel to the front edge of the desk by relative movement of coaxial tube sections extending generally in the first direction to slide the support arm as a whole in the first direction, said coaxial tube sections being selectively lockable in a plurality of different relative positions to position the support arm in a plurality of different lateral positions relative to the desk, (ii) in a second direction perpendicular to the front edge of the desk by relative movement of coaxial tube sections extending generally in the second direction to slide the support arm as a whole in the second direction, said coaxial tube sections being selectively lockable in a plurality of different relative coaxial positions to position the support arm at a plurality of different distances from the desk, and (iii) vertically by pivotal movement of a first one of a pair of coaxial tube sections relative to a second one of said pair of coaxial tube sections to move the support arm as a whole vertically, said relatively pivotable coaxial tube sections being selectively lockable in a plurality of different relative pivotal positions to position the support arm at a plurality of different vertical positions, to place said support arm in a plurality of different orientations relative to the working surface of the desk.

12. An apparatus as set forth in claim 11 including a pivotal adjuster on an outer end portion of said support arm, said armrest being supported by said pivotal adjuster on said outer end portion of said support arm for movement in three degrees of freedom for enabling levelling of said armrest when said support arm is in any one of said plurality of different orientations relative to the working surface of the desk.

13. An apparatus as set forth in claim 1 wherein said armrest has a relatively hard shell and a relatively soft arm contact surface and an inflatable bladder within said shell for varying the contour of said arm contact surface without varying the contour of said shell.

14. An apparatus as set forth in claim 1 wherein said armrest has a relatively hard shell and a relatively soft arm contact surface, said apparatus further comprising a plurality of discrete individual pieces of padding selectively insertable into said armrest between said shell and said arm contact surface for varying the contour of said arm contact surface without varying the contour of said shell.

* * * * *